US006394224B1

(12) United States Patent
Liu

(10) Patent No.: US 6,394,224 B1
(45) Date of Patent: May 28, 2002

(54) STRUCTURE OF SPEAKER

(76) Inventor: Chun-I Liu, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/537,487

(22) Filed: Mar. 30, 2000

(51) Int. Cl.[7] ..... G10K 13/00; H04R 7/00

(52) U.S. Cl. ..... 181/171; 181/172; 181/168; 381/386; 381/392; 381/395

(58) Field of Search ..... 181/171, 153, 181/165, 168, 172; 381/300, 332, 361, 386, 395, 392; D14/204, 210, 214, 215

(56) References Cited

U.S. PATENT DOCUMENTS

| | | | | | |
|---|---|---|---|---|---|
| 3,955,055 | A | * | 5/1976 | Kawakami et al. | 179/115.5 R |
| 4,016,376 | A | * | 4/1977 | Neuhof | 179/115 R |
| 4,359,133 | A | * | 11/1982 | Krolak | 181/172 |
| 5,062,140 | A | * | 10/1991 | Inanaga et al. | 381/199 |
| 5,734,132 | A | * | 3/1998 | Proni | 181/171 |
| D430,141 | S | * | 8/2000 | Liu | D14/215 |

FOREIGN PATENT DOCUMENTS

| | | | | |
|---|---|---|---|---|
| JP | 411088987 | * | 3/1999 | H04R/9/06 |

* cited by examiner

*Primary Examiner*—Robert E. Nappi
*Assistant Examiner*—Edgar San Martin
(74) *Attorney, Agent, or Firm*—Troxell Law Office PLLC

(57) ABSTRACT

A speaker structure having a supporting base with a magnetic circuit in a lower portion, a sound cylinder with a tube with wires on one end, which one end is placed in the magnetic circuit and the other end is higher than the supporting base. A vibration diaphragm having a round concave shape covers the top of the sound cylinder. A flexible free end fixture with a wave transmission in the middle section has one end connected to the supporting base and the other end directly connected to the tube of the sound cylinder. Thus favorable movement flexibility is achieved by the adhesion of the free end fixture at the lateral side of the sound cylinder. The space above the sound cylinder is vacant to independently install a vibration diaphragm with an enlarged area to effectively enhance the output of sound pressure.

1 Claim, 5 Drawing Sheets

STRUCTURE OF SPEAKER

BACKGROUND OF THE INVENTION

1. Field of the Invention

The invention is related to an improved speaker, especially, a kind of speaker structure, which is able to maintain steady vertical movement for a sound cylinder and of which the vibration diaphragm of the speaker structure can greatly enhance sound pressure.

2. Description of the Prior Art

The speaker of prior art is shown in FIG. 1. A free end fixture is located at the joint of a vibration diaphragm and a frame of a speaker to support the surroundings of a vibration diaphragm and to block airflow near the vibration diaphragm. It is advantageous to the back and forth movement of a sound cylinder.

An optimal free end fixture requires active support, favorable compliance, better vibration absorption and restoration. Because active support makes a sound cylinder maintain back and forth movement in straight. Favorable compliance will not stiffen free end fixture and restrict the back and forth movement of a sound cylinder. Better vibration absorption and restoration influence sound imperfection in a range of middle and low pitch.

For a speaker of prior art, the free end fixture is stuck on a vibration diaphragm. Thus, the following defectives are caused.

1. To a sound cylinder, it is based on indirect wrapping of a vibration diaphragm and it is unable to make optimal and steady movement. When the power of sound output increases, the sound quality of a speaker becomes imperfect, therefore the power of sound output is limited.
2. The method of connection for vibration diaphragm and sound cylinder makes it impossible to reduce the volume of a speaker on the basis of the requirement of high sound quality.

Due to the above fact, the inventor conducts constant research and study. Finally, the invention is successful after a series of tests and improvement.

SUMMARY OF THE INVENTION

The primary objective of invention is to design an improved speaker, especially, a kind of speaker structure, which is able to maintain steady vertical movement for a sound cylinder and of which the vibration diaphragm of the speaker structure can greatly enhance sound pressure.

To achieve the above objective, the improved speaker structure of the invention is primarily comprised of a supporting base, which equips a magnetic circuit (i.e. a round iron) in the lower portion, a sound cylinder equipping a tube in suitable length with wires which one end is placed in magnetic circuit (i.e. a round iron) and the other end is higher than a supporting base, a vibration diaphragm in round concave shape to cover the top of a sound cylinder, and a free end fixture. The free end fixture is a flexibility object with wave transmission in the middle section with one end connected to the surface of a supporting base and the other side directly connected to the tube of a sound cylinder. Thus favorable movement flexibility is achieved by the adhesion of free end fixture at the lateral side of a sound cylinder. In the meantime, the space above a sound cylinder is vacant to independently install a vibration diaphragm with enlarged area to effectively enhance the output of sound pressure.

The followings are brief description for optimal embodiments of the invention for committee's better understanding in the structural assembly and operations of the invention.

DETAILED DESCRIPTION OF THE PREFERRED EMBODIMENT

Figure 1:
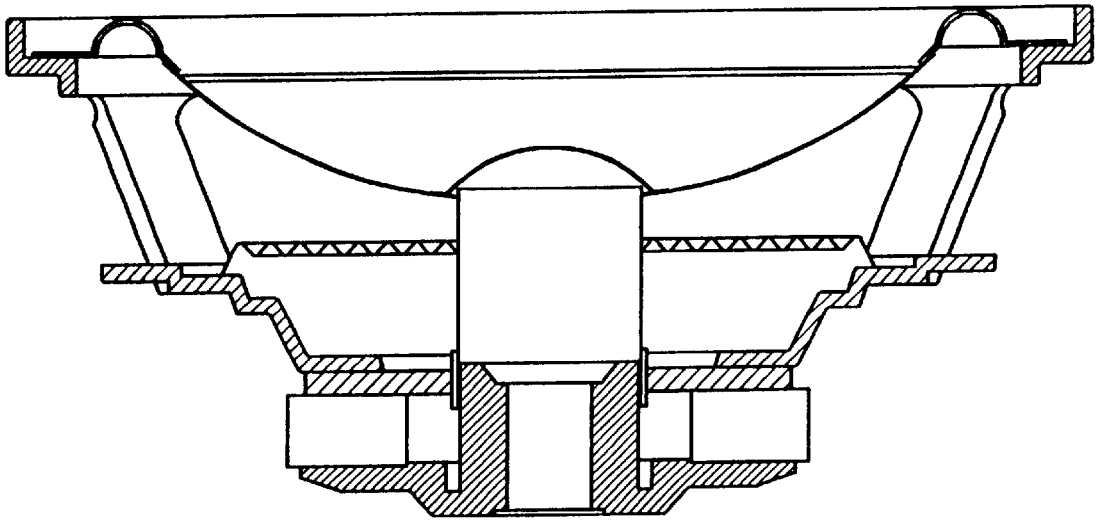
FIG.1 Prior Art
FIG. 1 is a section drawing for a speaker of prior art.
Figure 2:
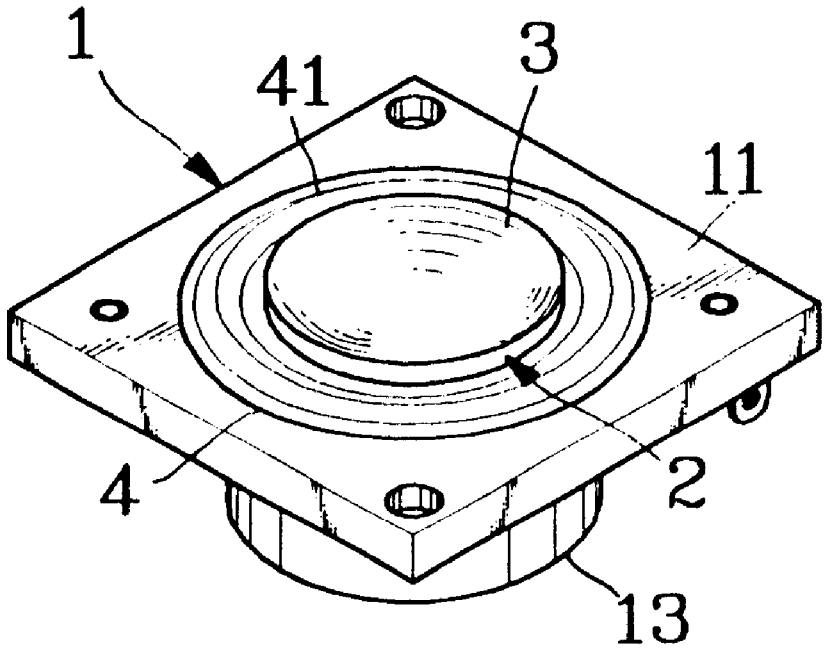
FIG. 2 is an isometric drawing of the invention.
Figure 3:
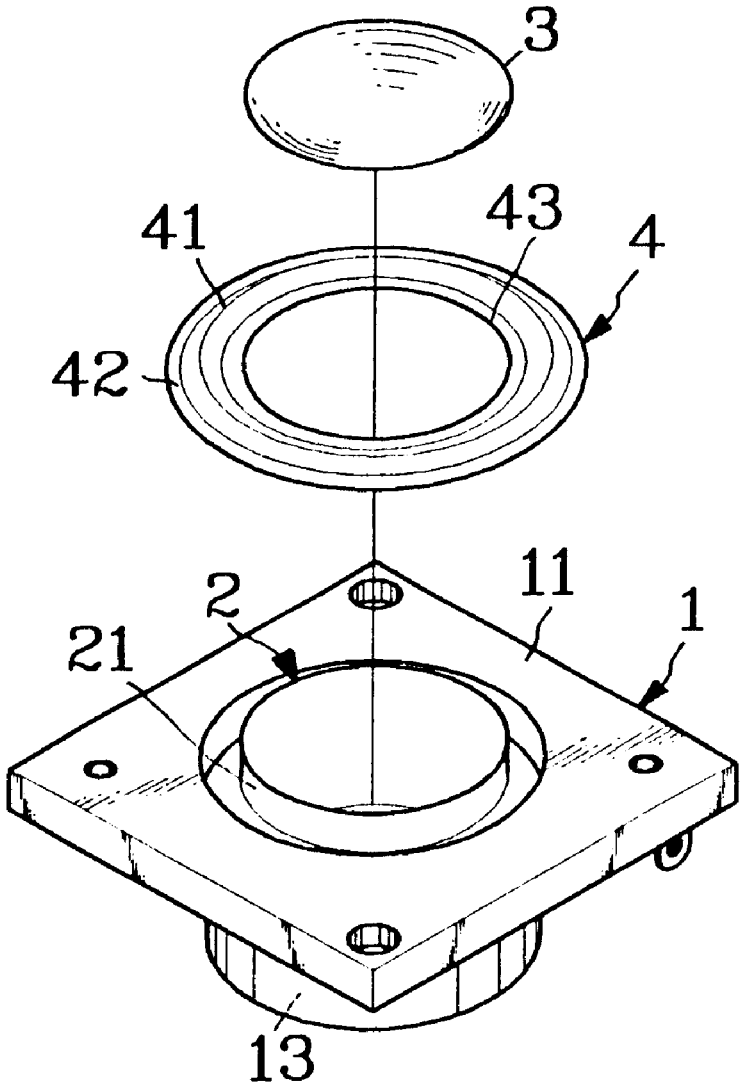
FIG. 3 is an exploded drawing of the invention.

As shown in FIGS. 2–5, the invention of a speaker structure mainly includes supporting base 1, sound cylinder 2, vibration diaphragm 3, and free end fixture 4. Supporting base 1 has a platform 11 with multiple holes at the top and a connection portion with multiple claws 12 to join magnetic circuit 13 (i.e. round iron) with internal washer 131 and magnetic iron 132.

Sound cylinder 2 has a tube of suitable length with wires 22, one end of which is placed in magnetic circuit 13 (i.e. a round iron) and the other end is higher than supporting base 1.

Vibration diaphragm 3 is in round concave shape to cover the top of sound cylinder 2 with optional embodiment of metal diaphragm.

Free end fixture 4 is a flexibility object with wave transmission 41 in the middle section. One of its extension end 42 is connected to platform 11 of a supporting base and the other extension end 43 is directly connected to the tube of a sound cylinder 21.

Figure 4:
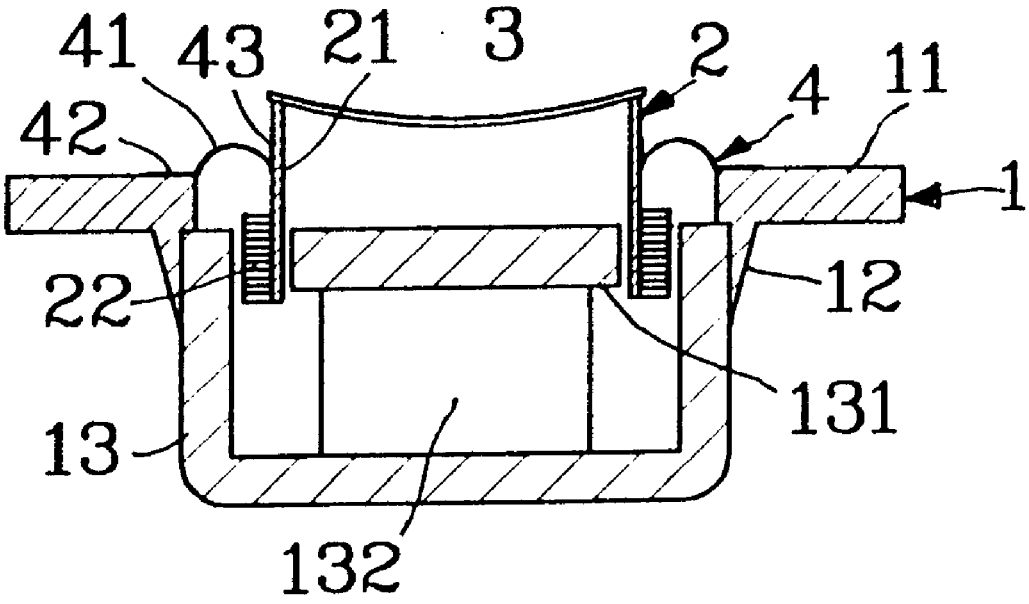
FIG. 4 is an assembly drawing of the invention.

Thus, as shown in FIG. 4, the invention is characterized as that tube 21 of a sound cylinder is designed with suitable length for the adhesion of free end fixture4 at the lateral side of sound cylinder 2 at assembly. In the meantime, the space above sound cylinder 2 is vacant to independently install vibration diaphragm 3 with enlarged area to effectively enhance the output of sound pressure.

Figure 5:
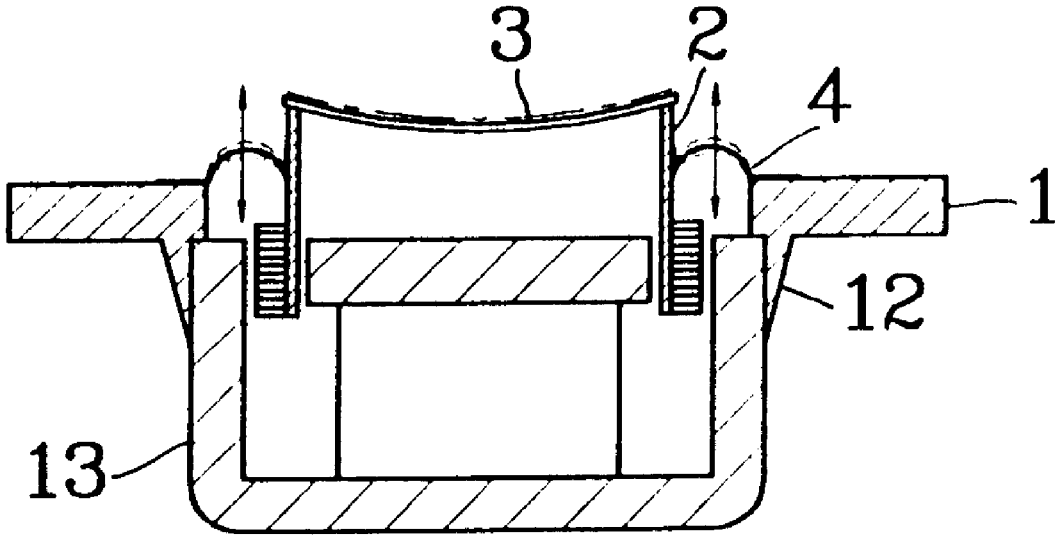
FIG. 5 is a drawing of an embodiment of the invention in an open state.

As shown in FIG. 5, for the integral design, free end fixture 4 is directly fixed on sound cylinder 2 instead of passing through vibration diaphragm 3. Favorable flexibility for back and forth movement is achieved in an open state to enhance vibration stability for sound cylinder 2 and to increase sound output power. Therefore, the invention is much more advantageous than the invention of prior art.

The above explanation is a substantial embodiment of the invention, which provides greater practical performance than products of prior art.

What is claimed is:

1. A speaker structure comprising: a supporting base, having a magnetic circuit in a lower portion, the supporting base further including a platform with a plurality of holes and a connection portion with multiple claws; a sound cylinder having a tube with wires on a first end which is located in the magnetic circuit and a second end located above the supporting base; a vibration diaphragm in round concave shape disposed on and covering a top of the sound cylinder, the vibration diaphragm comprising a metal panel; and a flexible free end fixture with wave transmission middle section, a first end connected to the supporting base and a second end connected directly to the tube of the sound cylinder, such that the second end of the sound cylinder is located above the flexible free end fixture.

* * * * *